US005608416A

United States Patent [19]

Champion et al.

[11] Patent Number: 5,608,416

[45] Date of Patent: Mar. 4, 1997

[54] PORTABLE RAPIDLY ERECTABLE DISCONE ANTENNA

[75] Inventors: James R. Champion, Ellicott City, Md.; Denver N. Tenney, Vienna, Va.; Laurence C. Simms, Baltimore, Md.

[73] Assignee: The Johns Hopkins University, Baltimore, Md.

[21] Appl. No.: 557,871

[22] Filed: Nov. 14, 1995

Related U.S. Application Data

[63] Continuation of Ser. No. 388,126, Feb. 13, 1995, abandoned, which is a continuation of Ser. No. 49,334, Apr. 21, 1993, abandoned.

[51] Int. Cl.[6] ..... H01Q 13/00

[52] U.S. Cl. ..... 343/773; 343/846; 343/890; 343/896

[58] Field of Search ..... 343/846, 848, 343/773, 901, 847, 878, 888, 890, 891, 829, 896; H01Q 1/48, 13/00

[56] References Cited

U.S. PATENT DOCUMENTS

| | | | |
|---|---|---|---|
| 1,573,171 | 2/1926 | Kron foth | 343/896 |
| 1,655,892 | 1/1928 | Colburn | 343/891 |
| 1,803,620 | 5/1931 | Jester | 343/890 X |
| 1,852,925 | 4/1932 | Gomery | 343/891 X |
| 1,933,959 | 11/1933 | Block | 343/891 X |
| 2,189,309 | 8/1947 | Carlson et al. | 343/896 X |

(List continued on next page.)

FOREIGN PATENT DOCUMENTS

| | | | |
|---|---|---|---|
| 0880604 | 6/1953 | Germany | 343/848 |
| 0031203 | 2/1982 | Japan | 343/896 |
| 1502100 | 5/1975 | United Kingdom | 343/773 |
| 1508784 | 4/1978 | United Kingdom | 343/846 |

OTHER PUBLICATIONS

J.R.Champion, The Utility of High Frequency Ground Wave in a Distributed Communication System, pp. 4–1–4–5, 1991.

A.G.Kandoian, Three New Antenna Types and Their Applications, Feb., 1946; pp. 70W–75W; Waves and Electrons.

J.J.Nail, Designing Disconne Antennas; Electronics–Aug. 1953, pp. 167–169.

Boyer, Joseph M., "Discone–40 to 500 Mc Skywire", Jul., 1949, pp. 11–15.

Barbano, Normond, "The Aerodiscone Antenna", Nov., 1966, pp. 57–62.

Kubba et al, "A Wide Band Discone Antenna", Apr., 1971, pp. 57–59.

Balinis, "Antenna Theory Analysis and Design", 1982, pp. 346–347.

Hall et al, "The ARRL Antenna Handbook", 1983, pp. 11–24/25.

*Primary Examiner*—Donald T. Hajec
*Assistant Examiner*—Steven Wigmore
*Attorney, Agent, or Firm*—Mary Louise Beall; Eugene J. Pawlikowski

[57] ABSTRACT

This invention is a lightweight, portable, quickly assembled, wide band, discone antenna for high frequency ground wave communication. The disk portion of the antenna is formed of telescoping spokes and the cone portion is formed of separate retractable wire elements. Disassembled, the antenna can be carried in a backpack. It can be assembled in less than ten minutes to achieve non-fading, non-line-of-sight communication.

3 Claims, 7 Drawing Sheets

U.S. PATENT DOCUMENTS

| | | | |
|---|---|---|---|
| 2,419,538 | 4/1947 | Clark | 343/901 |
| 2,618,746 | 11/1952 | Pauch | 343/890 |
| 3,189,906 | 6/1965 | Kulik et al. | 343/877 |
| 3,518,694 | 6/1970 | Kuecken | 343/848 |
| 3,579,244 | 5/1971 | Dempsey et al. | 343/797 |
| 3,618,107 | 11/1971 | Spanos | 343/773 |
| 3,701,159 | 10/1972 | Simonds | 343/745 |
| 3,787,865 | 1/1974 | MacDowell et al. | 343/773 X |
| 4,143,377 | 3/1979 | Salvat et al. | 343/755 |
| 4,691,209 | 9/1987 | Kershaw | 343/846 |
| 4,743,917 | 5/1988 | Huntsman et al. | 343/877 |
| 4,750,001 | 6/1988 | Grose et al. | 343/877 |
| 4,804,973 | 2/1989 | Ackman | 343/888 |
| 4,851,859 | 7/1989 | Rappaport | 343/773 X |
| 4,872,022 | 10/1989 | Schock | 343/891 X |
| 4,918,460 | 4/1990 | Collins et al. | 343/877 |

$$L=(\lambda/4)\times 0.96=C_{max}$$

$$D=0.7\ C_{max}$$

$$C_{min}\leq L/22$$

$$S=0.3\ C_{min}$$

PORTABLE RAPIDLY ERECTABLE DISCONE ANTENNA

STATEMENT OF GOVERNMENTAL INTEREST

The Government has rights in this invention pursuant to Contract No. N00039-89-C-5301.

This is a continuation of application Ser. No. 08/388,126, filed on Feb. 13, 1995, now abandoned which is a continuation of Ser. No. 08/049,334, filed on Apr. 21, 1993, now abandoned.

BACKGROUND OF THE INVENTION

The present invention is a portable, rapidly erectable and easy to disassemble discone antenna for use in wide band, high frequency ground wave communication.

A study entitled "The Utility of High Frequency Ground Wave In a Distributed Communication System" by one of the inventors James R. Champion was described at a scientific conference Oct. 15, 1990 and was published in *Conference Proceedings C. P.* 486, *The Advisory Group for Aerospace R&D, Neuilly Sur Seine, France*, pp. 4-1 to 4–6, 1991. This reference does not describe the particular features of the invention relating to portability, ease of assembly and disassembly but deals mainly with its effectiveness as an antenna. (See paragraph 2.)

A discone antenna is described in "Three New Antenna Types and Their Applications", A. G. Kandoian, *Waves and Electrons,* 70 W–75 W, Feb, 1946. The benefits of grounding the antenna are mentioned on page 71 W.

Discone antennas are generally described in a scientific article entitled "Designing Discone Antennas", J. J. Nail, *Electronics*, Vol. 26, pp 167–169, Aug. 1953. The present antenna is constructed according to the basic relationships described in the article and illustrated in FIG. 1.

Neither of these two references discuss the portable feature of the instant invention.

U.S. Pat. No. 3,701,159 entitled "Discone Antenna", is an inverted discone antenna with the ground mat acting as the disc and the cone portion suspended from poles fixed in the ground. It is not useful for high frequency communications, is not portable and cannot be disassembled easily. (See abstract and paragraph bridging columns 1 and 2.)

U.S. Pat. No. 4,143,377 teaches a discone antenna variation wherein two discone antennae are used together, one mounted atop the other. (See abstract and FIG. 1). It is not portable and cannot be disassembled easily.

U.S. Pat. No. 4,918,460 describes a telescopic mast operating in conjunction with reels for winding sets of stays. The masts are useful to support antennas for mobile installations. (See abstract and column 1, paragraph 1.)

U.S. Pat. No. 3,189,906 is a conical antenna wherein the radiating elements serve to brace and support the antenna. This antenna can be adapted for quick assembly. (See column 2, lines 21–26.)

The following three patent references describe portable antennas not of the discone type.

U.S. Pat. No. 3,579,244 describes radiating elements made of flexible thin steel secured to a telescoping mast. Ground elements also made of the thin steel are secured to the mast in a plane perpendicular to the mast. (See abstract.)

Related patents U.S. 4,743,917 and U.S. Pat. No. 4,750,001 teach roll-out antennas wherein the antenna wire is wound onto a reel for transportation and storage. (See abstracts.)

OBJECTS OF THE INVENTION

It is an object of the present invention to produce a portable discone antenna.

Another object is to produce a discone antenna able to be easily and rapidly assembled and disassembled.

Still another object is to produce an discone antenna which, when disassembled, can be stored in a back pack and carried by one person.

It is also an object of the present invention to produce a robust, portable discone antenna able to be used for nuclear-survivable, non-fading, non-line-of-sight, high frequency ground wave communication.

SUMMARY OF THE INVENTION

This invention is an antenna wherein the conducting elements form a disc atop the small end of a cone with the plane of the disk perpendicular to the axis of the cone. The disc portion of the discone antenna has the aspect of a spoked wheel and is made of a plurality of telescoping linear elements each connected at its proximal end to a central hub. The linear elements are electrically tied together by attaching each element distal end to a wire formed into a circle. The connections to the hub and to the circular wire are detachable.

The cone portion of the discone antenna is made of a plurality of flexible wires connected at their proximal ends to the central hub and at their distal ends to the ground. A main feature of the invention is that the cone elements also serve as the support or guying means for the antenna. The connections to the hub and to the ground are detachable. The cone elements are connected to the ground in such a fashion that they are electrically isolated from the ground.

The central hub is supported by a mast. The disc portion and the cone portion of the central hub are electrically isolated from each other and from the mast.

The antenna is connected to a transceiver by a coaxial cable with the center wire connected to the disc portion and the outer conductor connected to the cone portion.

DESCRIPTION OF THE PREFERRED EMBODIMENTS

Figure 1:
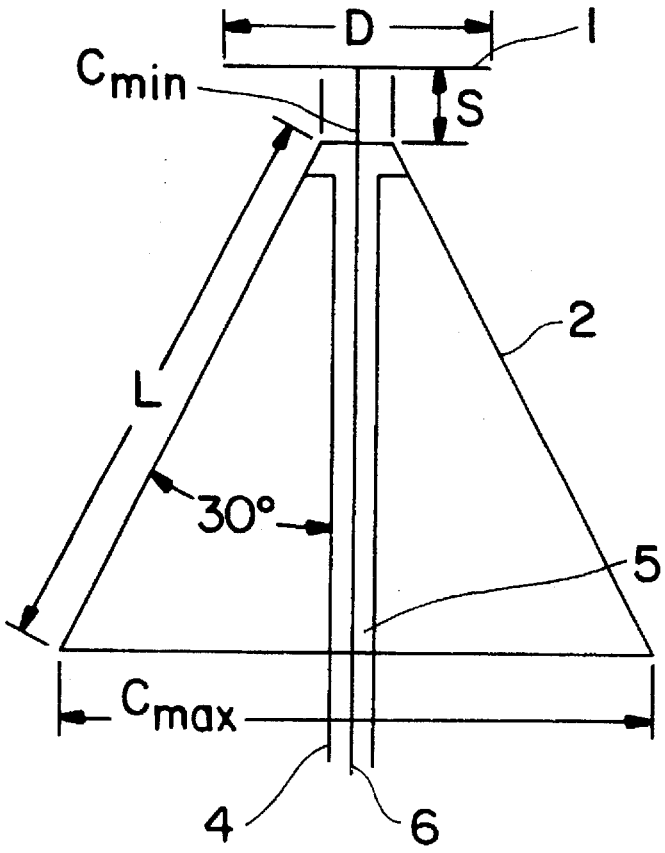
FIG. 1 is cross sectional representation of the discone antenna and a corresponding table of required relationships of the various elements of the antenna.

The preferred embodiment of the discone antenna of the present invention will first be described in reference to FIG.

1, wherein 1 is the disk and 2 is the cone. The outer conductor 4 of a coaxial cable 5 is connected to cone 2 of the antenna while the center wire 6 is connected to disk 1.

Also in FIG. 1, D represents the diameter of disk 1, $C_{min}$ is the minimum diameter of cone 2, $C_{max}$ is the maximum diameter of cone 2, S is the space between disk 1 and cone 2 and L is the length of the side of cone 2.

As discussed above, discone antennas generally are constructed according to parameters determined by relationships found in the Nail paper discussed above. These relationships are listed below in Table 1 and in FIG. 1. Note that all the parameters are related to the communication wave length λ.

$$L=(\lambda/4)\times 0.96\ C_{max}$$

$$D=0.7\ C_{max}$$

$$C_{min}=\leqq L/22$$

$$S=0.3\ C_{min}$$

As long as these parameters are met, a discone antenna may be constructed or tuned to be effective in a particular frequency range. The portable antenna of the invention is intended to be used for high frequency (HF) ground wave communication in the 20 to 30 MHz band range. A cut-off frequency of 18 MHz has been selected to provide good performance throughout the entire band. Using the relationships of Table 1 with λ=18 MHz produces the following, expressed in meters:

$C_{max}$=3.99
$C_{min}$=0.181
D=2.79
S=0.053
L=3.99

Figure 2:
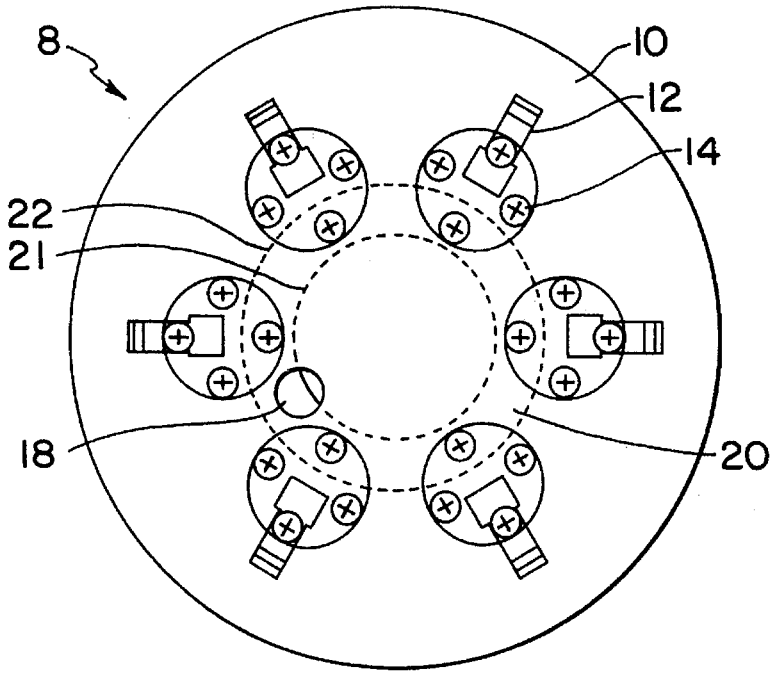
FIG. 2 is a drawing of the top plate assembly of the discone antenna.

The disk 1 incorporates six telescoping elements each provided at the proximal end with a bulkhead connector and a coupling unit (not shown). A top plate assembly generally indicated at 8 in FIG. 2, comprises a circular plate 10 the top side of which is provided with six right angle SMA connectors 12. Each SMA connector is secured to the plate with screws 14 but also may be welded to the plate. Note that there is no requirement that SMA connectors be used; the only requirement is that the telescoping elements are quickly and easily attached to the connectors 12. For example, a press fit type coupling could be used.

Figure 5:
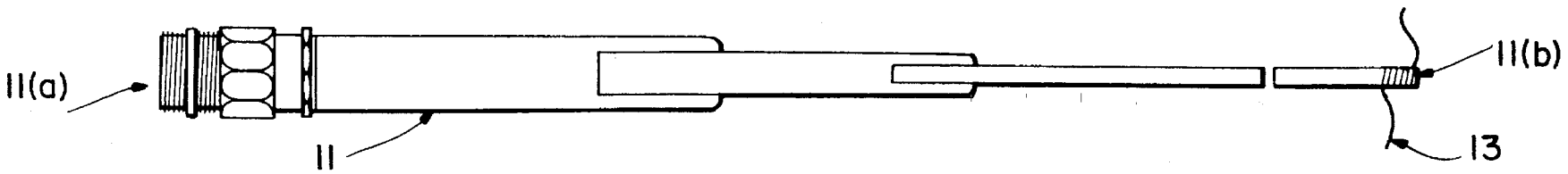
FIG. 5 shows a telescoping element extended to its full length.

One representative form of telescoping element is identified in FIG. 5 by the referenced numeral 11, with the individual segments shown extending between proximal and distal ends 11(*a*) and 11(*b*), respectively.

Figure 6:
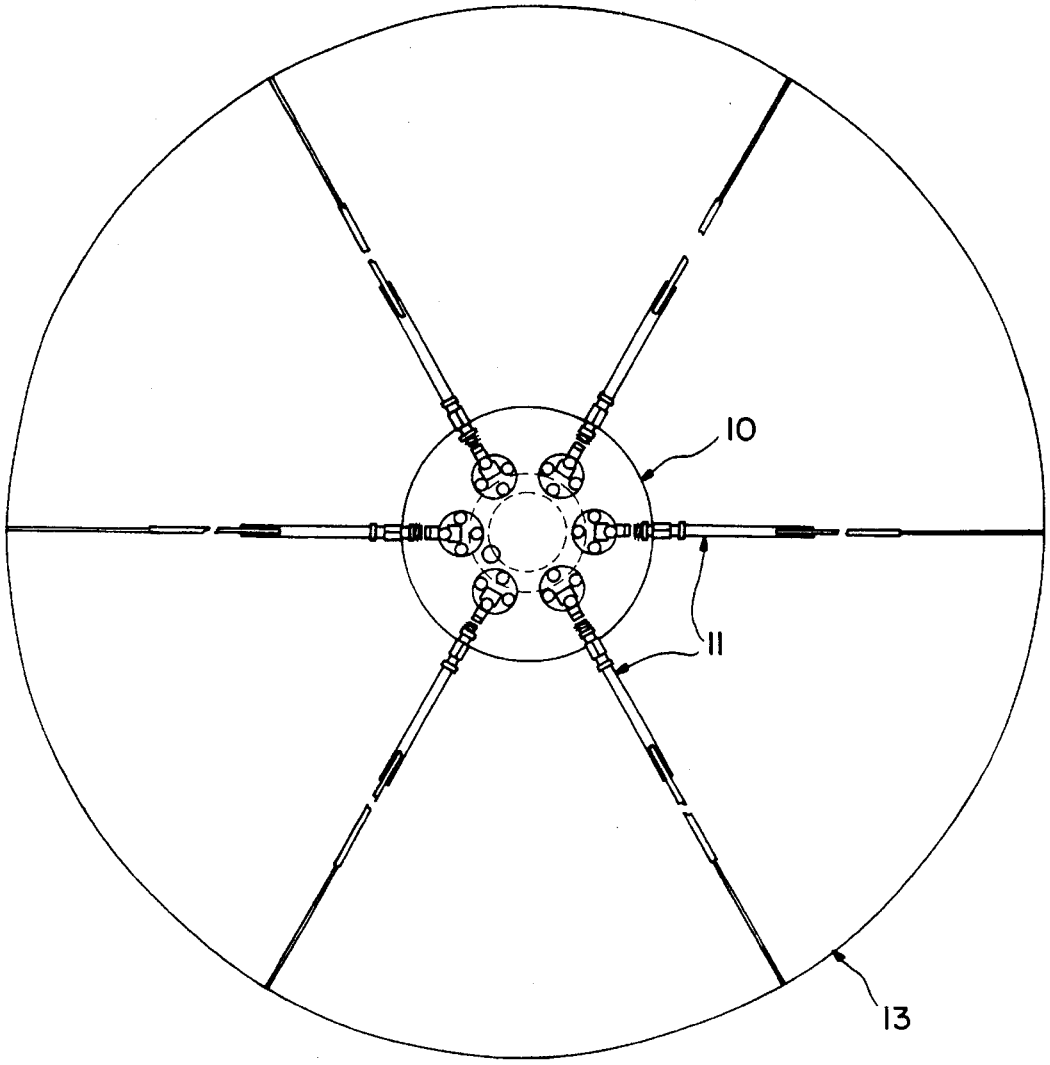
FIG. 6 is a plan view of the discone antenna embodying the invention showing a circular attachment to the ends of the telescoping elements.

To assemble the disk, the bulkhead connectors of the telescoping elements are secured to the SMA connectors 12 with the coupling unit. The elements are telescopically extended to a length of approximately 1.40 m measured from the center of top plate 10. The distal ends of the extended telescoping elements are electrically connected by attachment to a wire 13. The wire 13, as shown in FIG. 6, is understood to form a closed circle having six points of attachment to plate 10 of top plate assembly 8. Alternatively, this attachment may be a cup shaped member attached to the wire and pushed onto the distal end 11(*b*) or by using an alligator clip, for example.

The center feeder wire 6 of coaxial cable 5 from a transceiver (not shown) passes through opening 18 and is attached to top plate 10 at point 40. Top plate 10 rests on the top of hollow, inverted cup shaped, cylindrical spacer 20 having a height equal to S, a bottom surface 20*a* and a closed end 20*b*. The locations of cylindrical inner surface 21 and the cylindrical outer surface 22 in relation to top plate 10 are shown in dotted lines. These features will be discussed more fully below in reference to FIG. 4.

Figure 3:
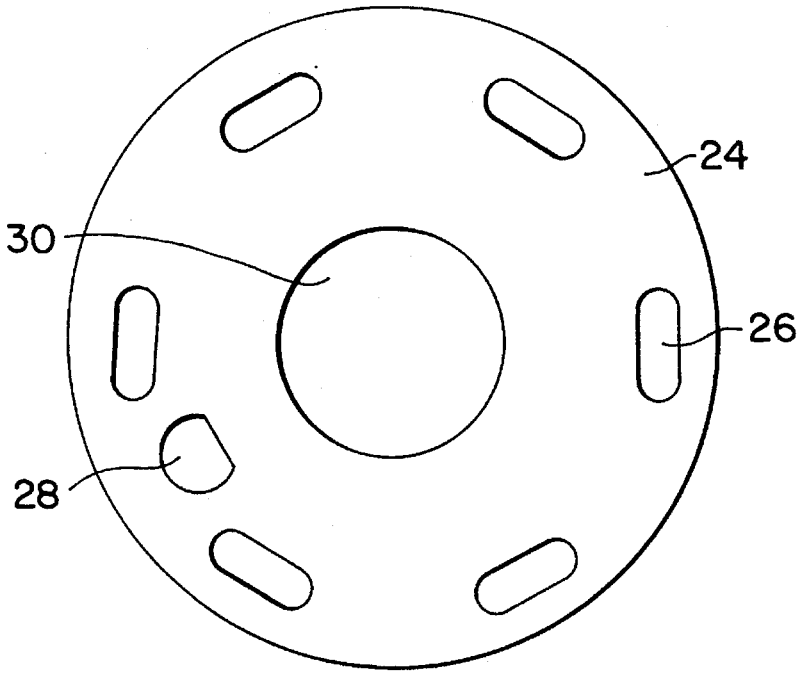
FIG. 3 is a drawing of the bottom plate of the discone antenna.

FIG. 3 shows the bottom plate 24 which forms the top of cone 2 and $C_{min}$. Plate 24 is provided with six slots 26. The elements of cone 2, shown as length L in FIG. 1, are formed by retractable steel wires that unroll from their own cases (not shown) in a fashion similar to retractable measuring tapes. (When the antenna is disassembled, the steel wires are retracted into the cases through the action of a spring loaded reel.) The free end of the wire is attached to a battery clamp which fits into slot 26 and thus electrically connects the wire to bottom plate 24 and to the other five wires. Each wire case is provided with means such as a rope loop and a stake to fix the case to the ground or other surface and to electrically isolate the wire from the ground. For the cut-off frequency of 18 MHz, the cone radiating elements must be about 3.99 meters in length. Instead of wires as radiating elements, retractable metal tapes may be used. Although a slot and battery clamp connection is described any means to electrically connect the radiating elements to the bottom plate may be used.

A mast 32 passes through opening 30 in bottom plate 24 and extends into spacer 20 a distance sufficient to engage bottom surface 20*a* of spacer 20 in abutting supporting relationship. Opening 28 is provided with a bulkhead connector 36 through which passes coaxial cable 5 from the transceiver (not shown). The bulkhead connector 36 connects the outer conductor 4 of cable 5 to bottom plate 24 and thus to the cone radiating elements.

The section of coaxial cable 5 leading to bulkhead connector 36 is secured along the length of mast 32 by electrical tape. However, clips or VELCRO fasteners may also be used. Securing the cable to the mast avoids extraneous RF (radio frequency) fields from the antenna inducing undesirable currents in the cable.

Figure 4:
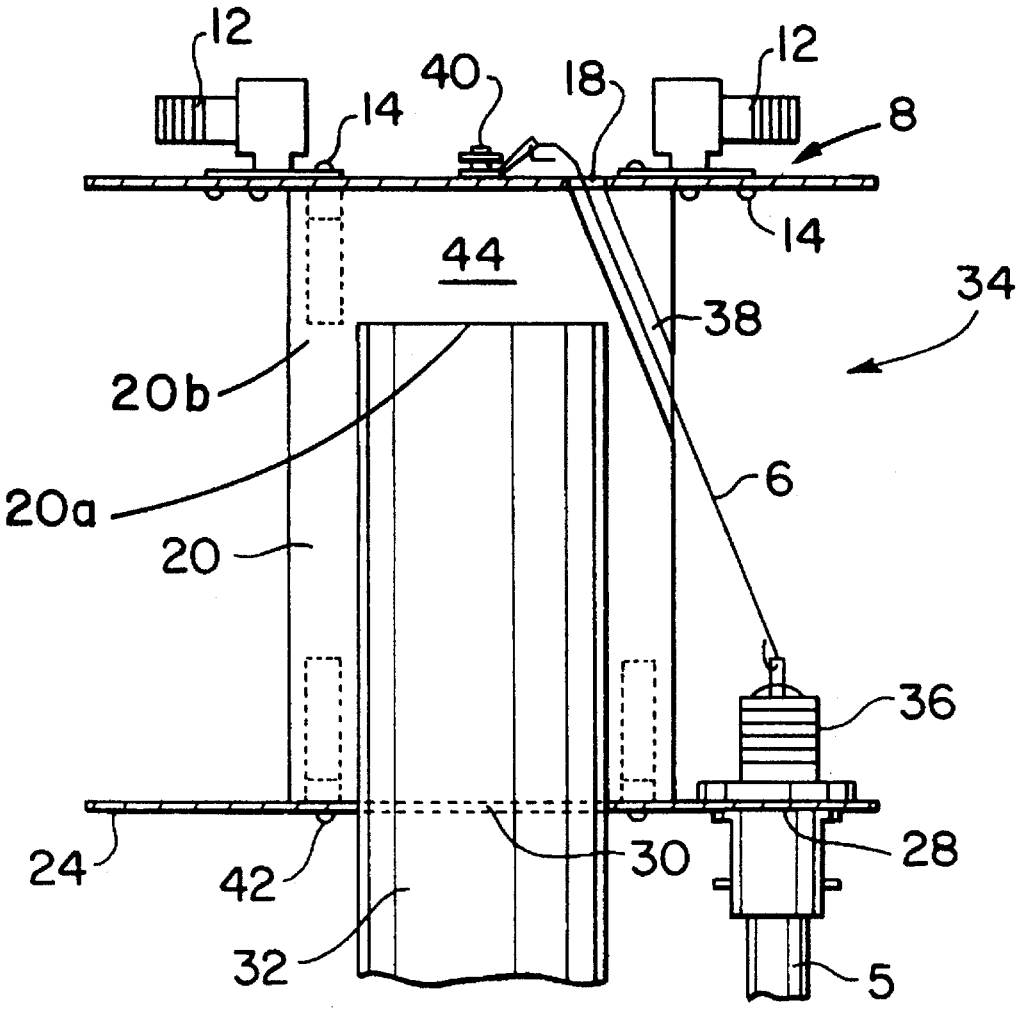
FIG. 4 is a sectional drawing showing details of the central hub.

The central hub of the discone antenna is generally indicated at 34 in FIG. 4. It comprises a top plate assembly 8, a hollow inverted cup shaped cylindrical spacer 20 and the bottom plate 24. The top plate assembly 8 is mounted on the flat closed end of spacer 20 and bottom plate 24 is mounted on the end of spacer 20 provided with the inverted cup. Spacer 20 is made of nonconducting material that electrically isolates the two metal plates 10 and 24 from each other and from mast 32. In the preferred embodiment, spacer 20 is made of a nonconducting phenolfiber material but other solid nonconductors such as wood may also be used.

In this preferred embodiment, spacer 20 is provided with a passage 38. This passage allows center wire 6 of coaxial cable 5 to be electrically connected to the center of top plate 10 at point 40.

Top plate 10 is fixed to spacer 20 by screws 14 and bottom plate 24 is fixed to spacer 20 by screws 42.

Figure 7:
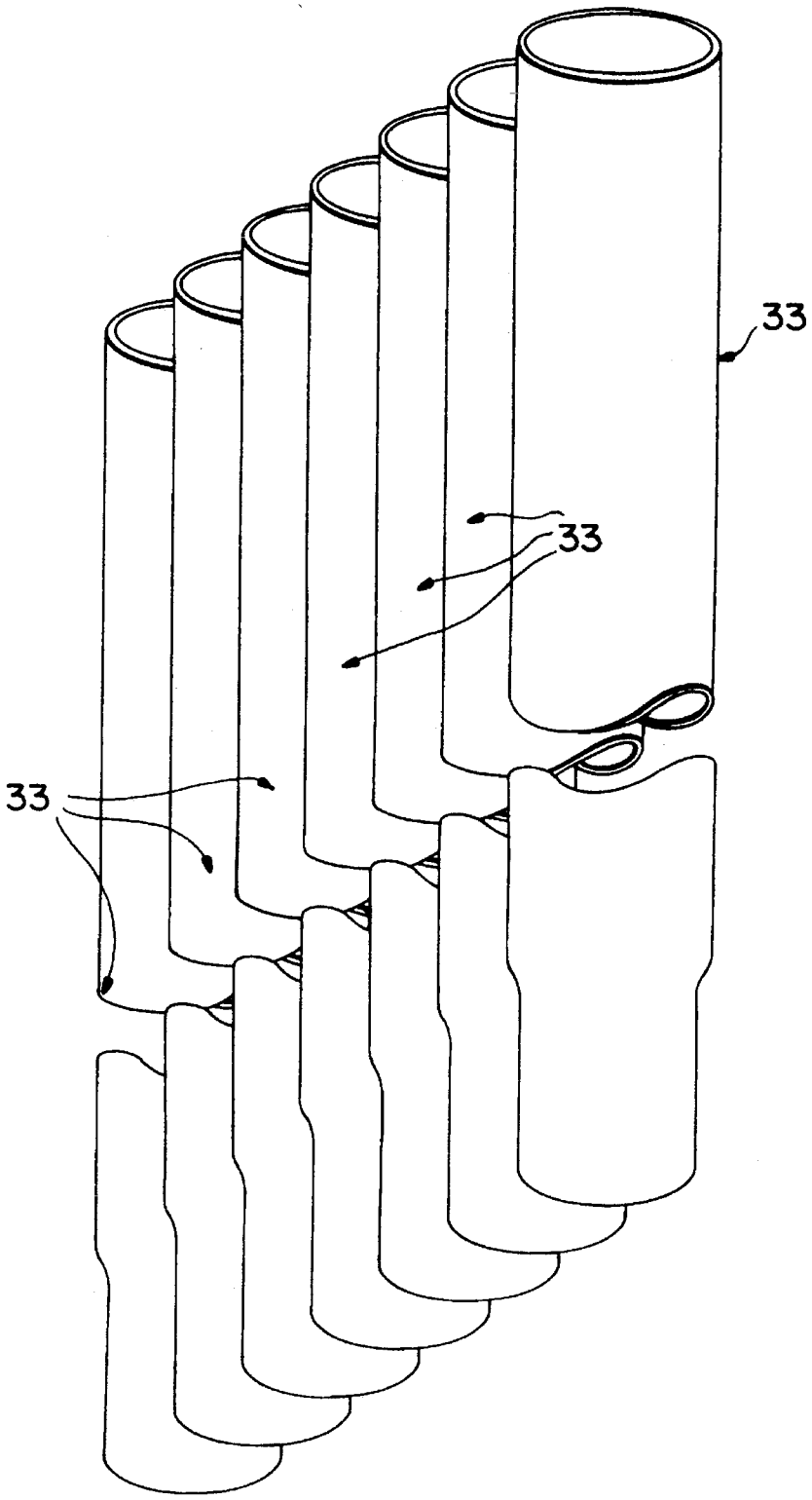
FIG. 7 shows the swaged tubes of the mast disassembled.

For ease in carrying, mast 32 is formed of a plurality of sections of swaged aluminum tubing 33 (shown disassembled in FIG. 7) but may be made of any number of sections, depending on the length L and packing requirements. The top of mast 32 is not fixed to cylindrical spacer 20 but is inserted into the spacer through opening 30 in bottom plate 20 to an extent that, when in supporting relationship to spacer 20, the end of the top section of mast 32 is separated from the bottom surface of top plate assembly 8 by the thickness of the closed end 20*b* of spacer 20. As shown in FIG. 4, the diameter of the tubular mast is such that it fits snugly into cylindrical cup of spacer 20. The bottom of mast 32 rests on the ground and may be provided with a base consisting of a flat plate to provide stability during antenna assembly. Because of the thickness of spacer 20 at location 44, mast 32 does not come in contact with and is electrically insulated from top plate 10. Since the diameter of opening 30 in bottom plate 24 is slightly greater than the inner diameter of spacer 20, mast 32 does not contact bottom plate 24 and is electrically insulated from it.

Figure 8:
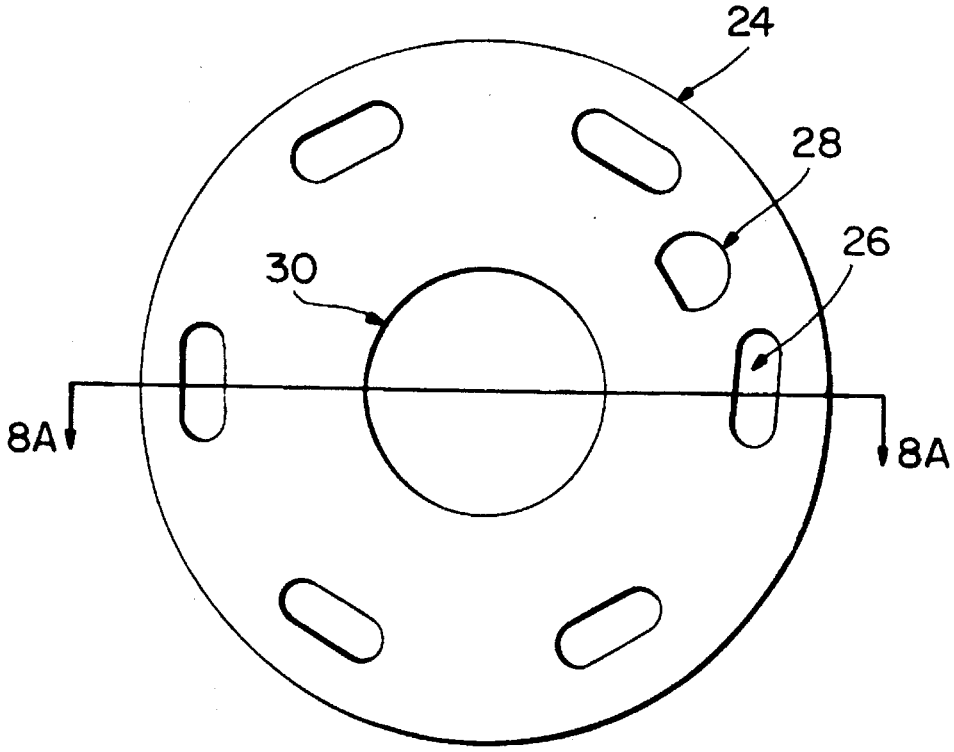
FIG. 8, partially in section, illustrates one form of quick release between the conical wires and the bottom plate of the top plate assembly.
Figure 8A:
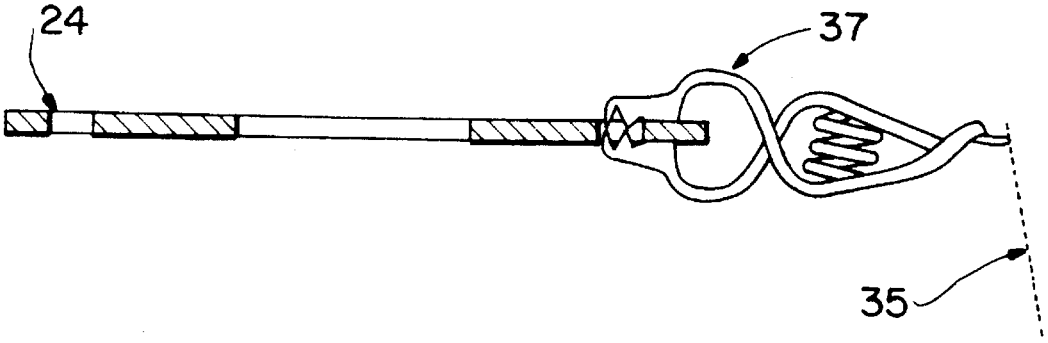

To assemble the antenna, mast 32 is assembled from the swaged sections and its upper end is inserted into hole 30 of central hub 34. The flexible wires 35 (shown in FIG. 8), forming cone 2 are fixed by alligator clips 37, for example into slots 26 in bottom plate 24 of central hub 34 and are unreeled a length L (FIG. 1) from their cases. Each case is staked to the ground or any other surface so that each flexible wire forms a an angle in the range of 15°–45°, and preferably 30° with mast 32. The flexible wires are made taut and thus stabilize or guy the antenna. Disk 1 is assembled atop cone 2 by connecting the proximal ends of the telescoping linear elements to the central hub and the distal ends to the circular wire. The linear elements are then extended to form a taut wagon wheel shaped structure. In this embodiment, the assembled antenna is approximately 3.5 meters tall.

To disassemble the antenna, the telescoping elements are telescoped inwardly to reduce the length and are disconnected from the circular wire and the central hub. The flexible wires are disconnected from the central hub as well as from the ground or other surface and reeled into their individual cases. The mast is disconnected from the central hub and is pulled apart into its individual segments. When all the parts have been disassembled, they can easily fit into a one foot wide by three foot deep sack.

Disassembled, the antenna can be carried in a back pack by an individual on foot and moved to another location. The exemplar created for the preferred embodiment weighs approximately 7.5 lbs.

The invention described is not intended to be limited to the embodiments disclosed but includes modifications made within the true spirit and scope of the invention.

We claim:

1. A central hub for a portable rapidly erectable discone antenna comprising:

a top plate assembly, an inverted cup shaped cylindrical spacer provided with a flat closed end and an open end and having a cylindrical interior which terminates in a bottom surface;

a bottom plate;

a plurality of flexible wires; and wherein the top plate assembly is mounted on said flat closed end of said spacer and is provided with means to detachably connect a plurality of telescoping linear elements to the central hub; and wherein said bottom plate is mounted on said open end of said spacer, and is provided with means for detachably connecting said flexible wires to the periphery of said bottom plate and is provided with a central opening having a diameter greater than the diameter of the cylindrical interior; and a supporting mast inserted through the central opening in said bottom plate and extending into the cylindrical interior of said spacer a distance sufficient to come into direct and removeable engagment with the bottom surface of said cylindrical interior of said spacer in abutting supporting relationship.

2. A central hub according to claim 1, wherein said mast is of metallic construction the spacer electrically isolates the top plate assembly, the bottom plate and the mast from one another.

3. A central hub according to claim 1, wherein the top plate assembly is provided with means to detachably connect to a plurality of telescoping linear elements to form a disk portion of the discone antenna, and the bottom plate is provided with means to detachably connect to said plurality of flexible wires to form a cone portion of the discone antenna.

* * * * *